US005318061A

United States Patent [19]

Saito

[11] Patent Number: 5,318,061

[45] Date of Patent: Jun. 7, 1994

[54] AUTOMATIC PROCESSOR FOR SILVER HALIDE LIGHT-SENSITIVE PHOTOGRAPHIC MATERIAL

[75] Inventor: Kaneo Saito, Hino, Japan

[73] Assignee: Konica Corporation, Tokyo, Japan

[21] Appl. No.: 960,927

[22] Filed: Oct. 13, 1992

[30] Foreign Application Priority Data

Oct. 16, 1991 [JP] Japan ..... 3-267833

[51] Int. Cl.[5] ..... G03D 3/06

[52] U.S. Cl. ..... 137/268; 354/324; 221/231; 221/232; 221/265; 221/298

[58] Field of Search ..... 137/268; 221/231, 232, 221/263, 264, 265, 279, 298; 354/324

[56] References Cited

U.S. PATENT DOCUMENTS

| | | | |
|---|---|---|---|
| 2,791,492 | 5/1957 | Isbell | 137/268 X |
| 2,865,156 | 12/1958 | Wolfson | 221/264 X |
| 3,233,778 | 2/1966 | Cobb et al. | 221/232 |
| 3,348,733 | 10/1967 | Johnson | 221/298 |
| 3,431,890 | 3/1969 | Ulary . | |
| 3,511,409 | 5/1970 | Huck | 221/231 X |
| 3,680,736 | 8/1972 | Viessmann | 221/231 X |
| 3,841,351 | 10/1974 | Shida | 354/324 X |
| 4,129,230 | 12/1978 | Billett et al. | 221/232 X |
| 4,263,932 | 4/1981 | Laar et al. | 354/324 X |
| 4,306,649 | 12/1981 | Berge | 221/298 X |
| 4,377,368 | 3/1983 | Koch | 221/298 X |
| 4,405,059 | 9/1983 | Kull | 221/298 X |
| 4,533,225 | 8/1985 | Shiga | 354/324 X |
| 4,705,379 | 11/1987 | Kobayashi et al. | 354/324 |

OTHER PUBLICATIONS

Patent Abstracts of Japan, vol. 13, No. 355 (P-914) Aug. 9, 1989 & JP-A-01 113 766 (Ricoh) May 2, 1989.

Patent Abstracts of Japan, vol. 12, No. 156 (P-701) May 13, 1988 & JP-A-62 273 537 (Konishiroku Photo Ind.) Nov. 27, 1987.

*Primary Examiner*—John Rivell

*Attorney, Agent, or Firm*—Frishauf, Holtz, Goodman & Woodward

[57] ABSTRACT

An apparatus for processing a silver halide photographic material in a processing vessel containing a processing solution in which a solid agent is fed into the vessel to keep the property of the processing solution within a predetermined level. A feeding device to feed the solid agent from a storage container to the processing vessel includes a feeding port through which the solid agent is fed into the processing vessel and a open-close mechanism to open or close the feeding port

19 Claims, 18 Drawing Sheets

AUTOMATIC PROCESSOR FOR SILVER HALIDE LIGHT-SENSITIVE PHOTOGRAPHIC MATERIAL

BACKGROUND OF THE INVENTION

The present invention relates to an automatic processor by which silver halide light-sensitive photographic material (hereinafter, called light-sensitive material) is processed. Specifically, the present invention relates to an improvement of a processing agent supply mechanism of an automatic processor by which compactness and operability of the automatic processor can be improved, and wherein stable photographic properties can be obtained.

The light-sensitive material is processed by the processes of development, desilverization, washing, and stabilization after the material has been exposed. Black and white developing solution and color developing solution are used for development, bleaching solution, a bleaching fixer and a fixer are used for desilverization, city water or ion exchange water is used for washing, and a stabilizer is used for stabilization processing. Temperature of each processing solution is adjusted commonly at 30° to 40° C., and the light-sensitive material is immersed in these processing solutions and processed.

These processes are conducted commonly in the following manner: the light-sensitive material is successively conveyed between processing containers in which the above-described processing solutions are contained, by the automatic processor.

In this case, a method is adopted by which replenisher is replenished into each processing solution so that activity of the processing solution in the processing container is kept constant.

Specifically, the processing operation is conducted while the replenisher is supplied when necessary into the processing container from a replenishing container.

In this case, the replenisher itself stored in the replenishing container is commonly prepared at another place, and is replenished into the replenishing container when needed. When the replenishing container requires replenishing, the following manual method is adopted.

A replenishing processing agent is supplied in the form of powder or liquid, and when it is used, in the case of powder, solution is prepared when powder is dissolved in a fixed amount of water, or in the case of liquid, since the agent is condensed, the agent is used after it has been diluted with a fixed amount of water.

Sometimes the replenishing container is mounted on the side of the automatic processor, and it is necessary to secure a considerable space for the container. Further, in a minilab, or photofinishing shop, the replenishing container is built in an automatic processor main body, and in this case, it is necessary to secure the space for the replenishing container.

In photographic processing, the replenishing processing agent is composed of various components (which are called component parts, hereinafter), and these component parts react and are deteriorated when they are contacted with each other for a long period of time, and thereby their functions as a photographic processing agent are deteriorated. Especially, since there are many agents which easily react on each other by the oxidation-reduction reaction in the processing agent, they are generally sorted into component parts in the form of a kit, and they are dissolved in a fixed amount of water when they are used.

Component parts formed into a kit are put into, for example, a bottle, a bag, or the like, and they are collected into a package (for example, corrugated cardboard) and sold in the market as one unit.

The replenishing processing agent in which component parts are formed into a kit is dissolved, diluted, and mixed, and after that, a fixed amount of replenishing processing agent is prepared. However, the replenishing processing agent has the following disadvantages: each component part is put into a vessel such as a bottle separately, and therefore, many bottles are necessary depending on the replenishing processing agent, and a large space is necessary when they are transported; and further there is a problem of disposing of waste bottles. When the replenishing processing agent is composed of several kinds of component parts, since each component part is put into a vessel separately, it takes too much time to find each component parts, and thereby operational efficiency for solution preparation is greatly lowered.

Accordingly, an object of the present invention is to provide an automatic processor which is structured in the following manner: the automatic processor is structured by only portions which are fundamentally essential to the processor, in order to be matched with a recent tendency of compactness of the automatic processor when development processing of the light-sensitive material is conducted by the automatic processor.

Recently, environmental protection and resource saving are greatly desired in many countries, centering around European countries and America. In photography, there is especially a problem of a polypropylene container for the replenishing processing agent. That is, the polypropylene container is cheap, convenient for storing or transportation, and excellent in chemical resistance. However, the waste container is buried, discarded, or burnt as industrial waste. Since the polypropylene container scarcely decomposes, when it is accumulated and burnt, a large amount of carbon dioxide is generated, and therefore, it generates a cause of global warming and acid rain. Further, on the user side, large quantities of the polypropylene containers are piled in a narrow operating space, and therefore, the space is even narrower.

Further, it is desired also to stabilize the property of a processing solution in order to stabilize the finishing quality of the light-sensitive material processed by the automatic processor. Important points to maintain stably the property of the processing solution, (from a recent tendency of small amount replenishing), are the control of the replenishing rate, and prevention from condensation of a replenishing solution by evaporation.

For the control of the replenishing rate, a periodical check of the replenishing amount is necessary. However, in point of fact, the manufacturer who has sold the automatic processor is in charge of the periodical check in small photofinishing shops, and a serviceman checks the replenishing rate once a month. Accordingly, even when the replenishing rate is not correct during the use of the processor, it remains incorrect till the following check. Further, for prevention of condensation of the replenishing solution by evaporation, evaporation correction is conducted as follows: when warming-up of the processor, which has been stopped since the previous day, has been completed, the user adds warm water to the processing solution whose liquid level has been lowered by evaporation. In this case, although it is preferable to conduct the evaporation correction regularly every day, when sometimes evaporation correction is forgotten, or another person is in charge of the processor, the above rule is not observed, and thereby it becomes a factor by which variation of the density of the processing solution is caused.

On the other hand, a solid processing agent must not be deteriorated before it is supplied to a processing agent replenishing container. Especially, the processing agent formed in a tablet is stored in a tablet storage means such as a cartridge, and it should be supplied to the replenishing container according to a command for replenishing. In this case, since the cartridge is placed in the vicinity of the processor, other tablets must be prevented from becoming wet by splattering of the solution when a tablet is supplied.

SUMMARY OF THE INVENTION

The first object of the present invention is to make the automatic processor compact by eliminating a replenishing solution stock container of the processor. The second object of the present invention is to provide a system in which plastic bottles are not used and thereby public pollution is not caused. The third object of the present invention is to provide an evaporation correction method by which the processing solution is not condensed. The fourth object of the present invention is to reduce labor by eliminating a solution preparation operation of the replenishing solution and an evaporation correction operation process by a manual operation. The fifth object of the present invention is to keep the quality of the solid processing agent always high.

These objects can be accomplished by one of the following technical means (a), (b), (c), (d), (e), (f), and (g).

(a) An automatic processor for processing silver halide light-sensitive photographic material, in which a supply apparatus for replenishing a solid processing agent is provided, the property of the processing solution contained in said automatic processor being maintained to be constant by said supply apparatus, said automatic processor comprising: a shutter plate as an example of the strage means which locates above the liquid surface of a processing solution and moves slidably on a bottom surface of a containing means; the solid processing agent for replenishing being contained in said containing means; wherein said shutter plate opens a port through which the solid processing agent is dropped when a supply signal for the solid processing agent is received; and the shutter plate closes the port when no supply signal is received.

(b) The automatic processor of item (a), wherein; the shutter plate closes the port when no supply signal for the solid processing agent is received; and the shutter plate opens the port when the supply signal is received so that a predetermined number of pieces of solid processing agent are conveyed to the port in the containing means and dropped into a processing agent supply container.

(c) An automatic processor for processing silver halide light-sensitive photographic material, in which a supply apparatus for replenishing a solid processing agent is provided, the property of the processing solution of the automatic processor being maintained to be constant by said supply apparatus, the automatic processor characterized in that: two shutter levers are provided to the port at the lowest portion of the containing means in which the solid processing agent for replenishing is contained and conveyed by rolling around its circumference under its own weight; wherein the solid processing agents located at the lowest position in said container enters between the two shutter levers, and is supplied by being dropped into the supply container when both shutter levers are opened and closed alternately.

(d) An automatic processor for processing silver halide photographic light-sensitive material of item (c), wherein both the shutter levers are alternately opened and closed, and can be rotated around a support shaft and are forced to be closed by springs; and they are alternately opened and closed when a pin-cam is rotated in one direction so that the solid processing agents are supplied by being dropped one by one.

(e) An automatic processor for processing silver halide light-sensitive photographic material, a supply apparatus for replenishing a solid processing agent being provided therein, the property of the processing solution of said automatic processor being maintained constant by said supply apparatus, said automatic processor being characterized in that: the solid processing agents are stacked in said containing means; the diameter of said containing means being sufficiently large for said solid processing agents to be dropped by their own weight; a window is provided in contact with the lower portion of the containing means; an inner diameter of said window being slightly larger than that of the containing means and a diameter of the solid processing agent; a rotatable shutter disc is provided in contact with the lower portion of the containing means; and the thickness of said rotatable shutter disc is slightly smaller than that of the solid processing agent; said rotatable shutter disc being provided in the manner that it can be rotated around a central shaft of a fixed disc having a thickness larger than that of said solid processing agent; said fixed disc being provided in coaxial relation to said rotatable shutter disc, wherein said window provided to said rotatable shutter disc, a second window having a slightly larger diameter than that of said window and provided to a predetermined position on the fixed disc and above the liquid surface of the processing solution in the processing agent replenishing container, and an opening positioned at the lower end of said containing means are provided in coaxial relation to said central shaft.

(f) The automatic processor for silver halide light-sensitive photographic material of any one of items (a), (b), (c), (d), and (e), wherein said solid processing agent is a tablet type processing agent.

(g) An automatic processor in which silver halide light-sensitive photographic material is conveyed for processing to processing containers, comprising a containing means containing a solid processing agent for replenishing so that the property of the processing solution in said processing containers can be maintained to be constant, said containing means comprising; a supply opening through which said solid processing agent is supplied; a separating means separating said solid processing agent supplied from said supply opening one by one; and a dropping means dropping one piece of said processing agent separated by said separating means into the processing container.

DETAILED DESCRIPTION OF THE PREFERRED EMBODIMENT

The first example will be described as follows according to the present invention in detail. However, the embodiment of the present invention is not limited to the following explanation.

Figure 1:
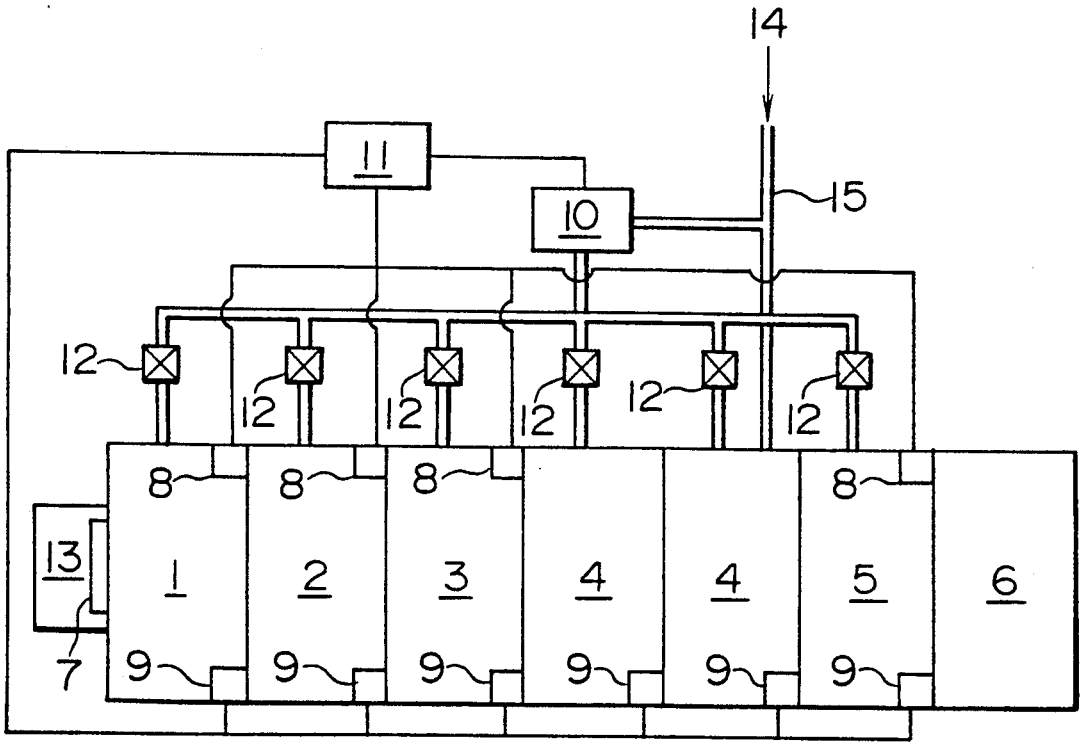
FIG. 1 is a view showing the outline of an automatic processor of the present invention.

FIG. 1 is an illustration showing the outline of an automatic processor according to the present invention, and showing a control mechanism of a color negative film processor.

When a color negative film is conveyed from a light-sensitive material insertion section 13, passes through a sensor 7 for light-sensitive material area detection, and a predetermined area is detected, a solid processing agent supply unit 8 for replenishing, a replenishing water supply unit 10 and a magnet valve 12 receive a signal from a control section 11 and are operated, and the processing agent for replenishing and replenishing water for solution preparation are supplied to processing containers 1, 2, 3, 4 and 5 at the required amount.

When the temperature of the automatic processor is controlled for several hours, a processing solution 17 in processing containers 1 to 5 evaporates, and when a liquid level of the solution is lowered below a predetermined liquid level, a liquid level detection sensor 9 is operated. Then, the replenishing water supply unit 10 and the magnet valve 12 are operated by a signal from the control section 11, and replenishing water for evaporation correction is supplied until an upper limit detection mechanism of the liquid level detection sensor 9 is operated. The temperature of washing hot water 14, which is replenishing water supplied by a replenishing water addition pipe 15, and that of the replenishing water for solution preparation and the replenishing water for evaporation correction are preferably controlled. In this case, in processing containers 1 to 5, numeral 1 indicates a color development container, numeral 2 indicates a bleaching container, numeral 3 indicates a fixing container, numeral 4 indicates a washing container and numeral 5 indicates a stabilizing container. Numeral 6 indicates a drying section.

Figure 2:
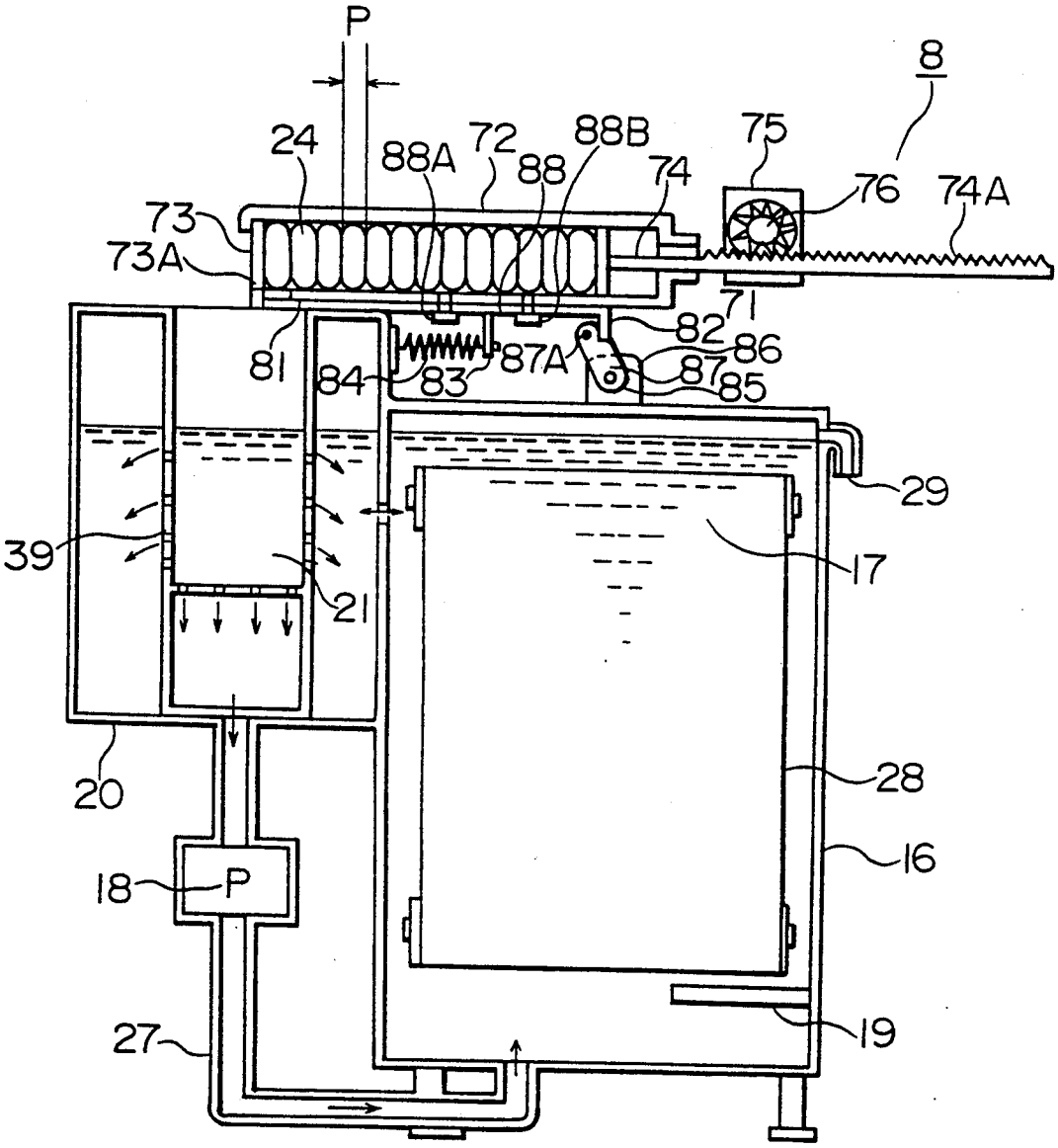
FIG. 2 is a view showing the outline of a condition of a shutter plate just before a solid processing agent is dropped into a processing container, in the first example.
Figure 3:
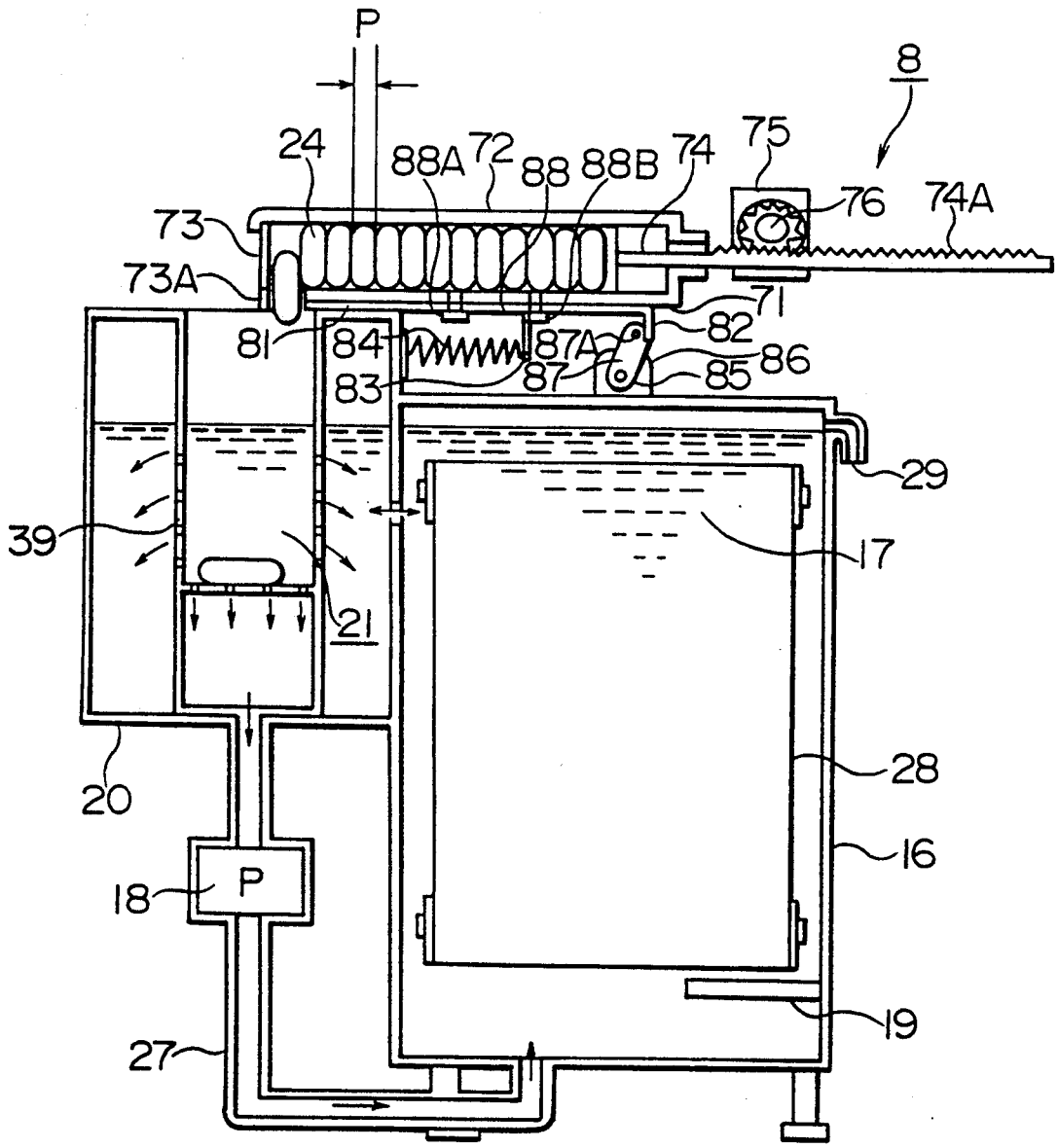
FIG. 3 is a view showing a condition where the shutter plate is opened after the solid processing agent has been dropped into the container in the first example.

In FIGS. 2 and 3, the outline of an example of the solid processing agent supply unit 8 for replenishing, in the case where a solid replenishing processing agent formed into a tablet is used, is shown.

The supply unit 8 is operated in the following manner: the control section 11 is operated when it receives a signal from the light-sensitive material area detection sensor 7; when a stepping motor 75 for supplying the replenishing solid processing agent is operated, a driving pinion 76 engaged with a rack 74A of a pushing plunger 74 for supplying the replenishing solid processing agent directly coupled with the stepping motor is advanced by one step, that is, the plunger 74 provided with the rack 74A is advanced by a pitch P which corresponds to a thickness of the processing agent; the leading solid processing agent 24 of the processing agents 24 in a containing means main body 71 stands by at a dropping position; and preparation for dropping one piece of the replenishing solid processing agents 24 contained in the containing means 71 into a filtering unit 21 provided in a processing agent supply container (hereinafter, called a sub-tank), which is a solution section for the replenishing processing agent of processing containers 1, 2, 3 and 5, is completed.

A shutter plate 81 contacting slidably with the surface of a base plate of the containing means main body 71 and reciprocating in the lateral direction is provided, a spring peg pin 83 is provided to the shutter plate 81, and a spring 84 is suspended from a fixed wall so that the shutter plate 81 is always urged to be closed. A stopper slot hole 88 is opened on the shutter plate 81. When the shutter plate 81 is closed as shown in FIG. 2, a stopper 88B is contacted with an end of the slot hole, and when the shutter is opened, a stopper 88A comes into contact with the other end of the slot hole. A bent portion 82 is provided to an end of the shutter plate 81. A lever 87 fixed to a shaft 85 of a stepping motor 86 is rotated clockwise according to a command signal for supplying the solid processing agent, and a pin 87A provided to an end portion of the lever 87 pushes the bent portion 82 so that the shutter plate 81 is opened.

In this case, the stepping motor may be replaced by a commonly used motor or a rotary solenoid. Stepping motors 75 and 86 are simultaneously operated by the supply command. The supplied replenishing solid processing agent 24 is gradually dissolved and supplied into a main processing tank 16 composed of processing containers 1, 2, 3 and 5 by a circulating pump 18. The number of pieces of supplied solid processing agents is not limited to one, but the number of pieces of the agents indicated by the command signal are supplied into the tank. In this case, when the system is structured in the manner that all or almost all of a circulating flow of a processing solution 17 circulating between the main processing tank 16 and the sub-tank 20 is passed through the filtering unit 21 provided in the sub-tank 20 directly by the circulating pump 18, the solubility of the replenishing solid processing agent is increased. In the drawing, numeral 19 is a heater for temperature control, numeral 27 is a communicating tube communicating the main processing tank structured by processing containers 1, 2, 3 and 5 to the sub-tank 20, numeral 28 is a processing rack, and numeral 29 is an overflow outlet.

As shown in FIGS. 2 and 3, the filtering unit 21 is used almost always as a solution container for supplied replenishing solid processing agent in order to produce satisfactory results. When a bottom portion of a filter 39 which forms a cylindrical portion around the filtering unit 21 is extended so that it comes into contact with a bottom portion of the sub-tank 20 as shown by a two dotted chain line, and an inlet port of a circulating system matches with the center of the bottom portion of the filter 39, solubility of the processing agent and filtering action for liquid pollution by the circulation between the sub-tank 20 and the main tank 16 can be obtained.

In this case, when the containing means main body 71 provided in the solid processing agent supply unit 8 is structured in the manner that: the containing means main body 71 is surrounded by four walls 73; a cover 72 is put on the upper portion of the main body 71; a port 73A through which the solid processing agent is dropped is provided at the leading edge portion of the base of the main body 71; and the shutter plate 81 is closed, the inside of the main body is sealed from the outside, and therefore, the inside of the main body is not contaminated by splattering of the processing solution or evaporation thereof.

Further, the dropping direction of the solid processing agent is preferably the direction shown in FIGS. 2 and 3, in which the flat surface of the solid processing agent is in the vertical direction so that spray of the solution is largely reduced.

Further, it is desirable to arrange a floating cover or a floating ball, which has been applied for by the inventors of the present invention at the same time as the present invention, on the liquid surface onto which the solid processing agent is dropped so that it functions as a cushion in order to reduce spray greatly.

The system is operated as follows: when a signal outputted from the light-sensitive material area detection sensor 7 is received, the control section 11 is operated; then, stepping motors 75 and 86 for supplying the replenishing solid processing agent, the pinion 76 driven thereby, the plunger 74 having the rack 74A which is moved linearly by the pinion 76, and the shutter 81 are operated; at the same time when the replenishing solid processing agent 24 is supplied, the replenishing water supply unit 10 and the magnet valve 12 are operated; and the replenishing water for solution preparation is supplied. A supply amount of the replenishing water for solution preparation is required to be more than the amount necessary for dissolving the replenishing solid processing agent 24, which can be solved by inputting the operation time of the magnet valve 12 and the replenishing water supply unit 10 into the control section 11 previously.

When the liquid level of the processing agent 17 contained in processing containers 1 to 5 is lowered by evaporation while the automatic processor is in the process of temperature control or is stopped, the liquid level detection sensor 9 detects the lowered liquid level, transmits the signal to the control section 11, operates the magnet valve 12 and the replenishing water supply unit 10, and supplies the replenishing water for evaporation compensation until the liquid level rises to regular liquid level. When the liquid level reaches the regular level, the liquid level detection sensor detects the regular level, transmits the signal to the control section 11, and stops the operations of the magnet valve 12 and the replenishing water supply unit 10.

Figure 4:
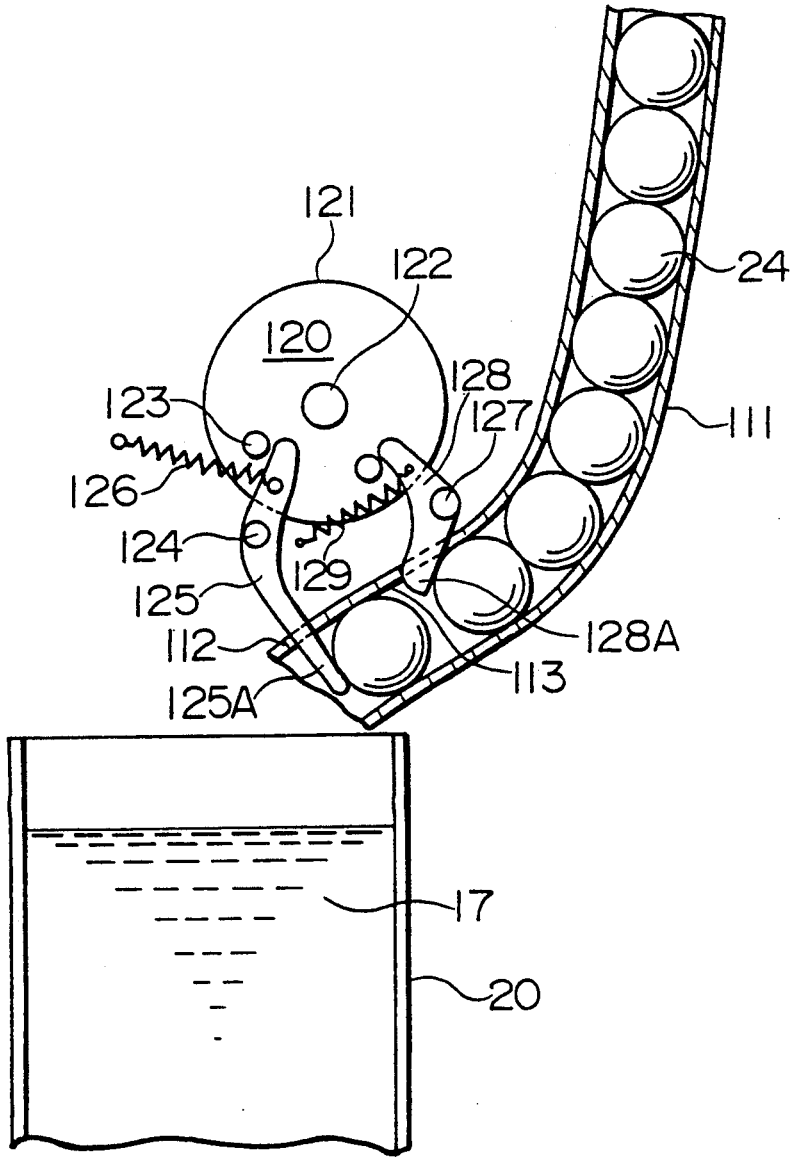
FIG. 4 is a side sectional view of a containing means in the second example.

Referring to the side sectional view in FIG. 4, the second example of a containing means having a shutter mechanism will be described as follows.

In the drawing, the containing means 111 in which a tablet type solid processing agent is contained is provided to the apparatus, and the containing means is structured in the manner that the processing agent can roll downward by its own weight in the containing means 111.

A shutter lever 125, which is rotated around a shaft 124 and urged to be rotated counterclockwise by a spring 126, is provided to the lower portion of the containing means 111. The leading edge 125A of the lever 125 enters into the inside of the containing means from a cut-out window 112 which is cut out in the containing means 111, and holds the lowest one 24A of the tablet type solid processing agent 24.

An end of the cut-out window 112 works as a stopper of the shutter lever 125. The second shutter lever 128 which holds all tablet type processing agents 24 above the lowest one 24A is provided, and the lever 128 is urged by a spring 129 in the manner that the lever 128 is rotated counterclockwise around a shaft 127.

Two shutter levers 125 and 128 are driven by a pin-cam which has a pin 123 on a disc 121, and is rotated around a shaft 122.

When the shutter lever is pushed by the pin 123 provided to the pin-cam 120 which is rotated counterclockwise and the leading edge 125A of the lever 125 is rotated clockwise, the lowest tablet type processing agent 24A is dropped into the sub-tank 20 which is a replenishing agent supply container. When the pin-cam 120 is further rotated in the arrowed direction, the pin 123 is separated from the shutter lever 125, then the shutter lever 125 returns to the place where it was and stands by for the next tablet type solid processing agent which is rolling down.

When the pin-cam is further rotated and pushes the second shutter lever 128, the shutter lever 128 is opened, all tablet type solid processing agents 24 are lowered by one tablet. When the pin-cam is further rotated and the pin 123 is separated from the shutter lever 128, the second shutter lever 128 returns to the position where it was, and holds all solid processing agents above the lowest one at the position.

The leading edge 128A of the shutter lever 128 enters into the containing means 111 from a window 113 which is cut out in the containing means, and an end of the window 113 works as a stopper for the lever 128.

When the pin-cam is further rotated, and the second rotation starts, the operation described above is repeated, and thereby the processing agent 24 can be supplied surely one by one to the sub-tank 20 which is the processing agent supply container.

In order to reduce the time interval for supplying the solid processing agent 24, when a plurality of pins 123 are provided at equal spaces, the time interval can be reduced to ½ or ⅓.

Figure 5:
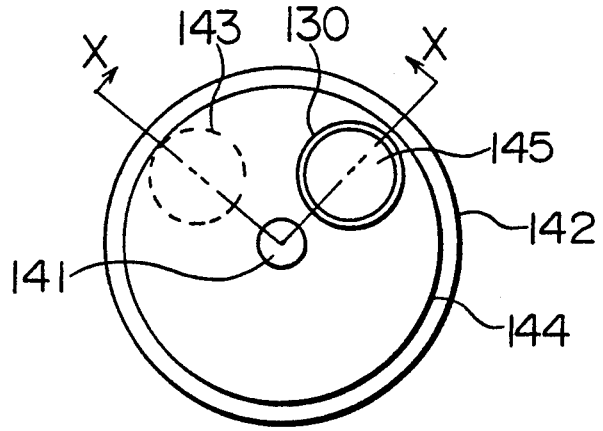
FIG. 5 is a plan view of the containing means in the third example.
Figure 6:
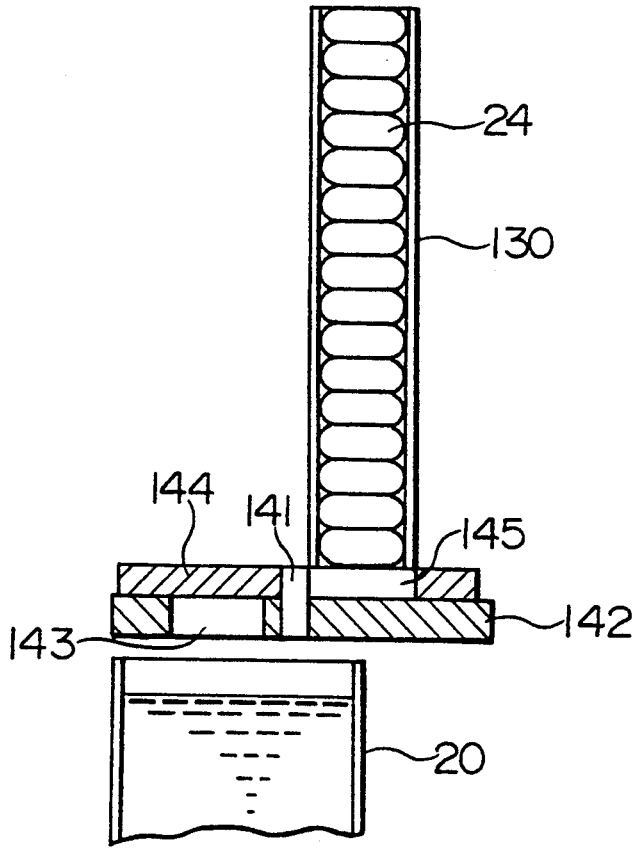
FIG. 6 is a side sectional view of the containing means in the third example.

Referring to the plan view in FIG. 5, and the side sectional view in FIG. 6, taken on line X—X in FIG. 5, the third example of the containing means having the shutter mechanism will be described as follows.

A cylindrical containing means 130 containing the tablet type solid processing agent 24 is provided to the apparatus and structured in the manner that: the processing agents are stacked horizontally; the processing agents are lowered downward by their own weight in the containing means 130 so that the agent can be supplied when the shutter is opened.

In order to form a bottom portion of the cylindrical containing means 130, a rotatable shutter disc 144 is provided in coaxial relation with the shaft 141 provided at a position which is apart from the center of the cylindrical containing means 130 by a predetermined distance. A fixed disc 142 is provided under the disc 144 and is contacted with the disc 144. The window 145 is provided to the disc 144 and the window 143 is provided to the disc 142, and they are provided concentrically to the cylindrical containing means 130.

An inner diameter of the window 145 provided on the rotatable shutter disc 144 is equal to or slightly larger than that of the cylindrical containing means 130 and an outer diameter of the tablet type solid processing agent.

The tablet type solid processing agent 24 is supplied as follows: the rotatable shutter disc 144 is rotated; the window 145 receives the lowest solid processing agent 24 at the position where the window 145 is entirely overlapped in the concentric relation with the cylindrical containing means 130 when the lowest solid processing agent 24 is dropped into the window 145; the rotatable shutter disc 144 is rotated further; the tablet type solid processing agent 24 received in the window 145 of the rotatable shutter disc 144 is dropped into the window 143 at the position in which the window 143 of the fixed disc 142 is overlapped concentrically with the window 145; and then, the solid processing agent 24 is supplied into the sub-tank 20 provided under the window 143.

After the lowest tablet type solid processing agent 24 is supplied into the sub-tank 20 as stated above, the tablet type solid processing agent 24 in the cylindrical containing means 130 remains stopped by the surface of the rotatable shutter disc 144. The processing agent 24 is held as it is on the surface of the rotatable shutter disc 144 until the rotatable shutter disc 144 starts rotation when the next supply signal is received and the lowest processing agent 24 is received by the window 145.

Since the inner diameter of the window 145 is larger than the outer diameter of the tablet type solid processing agent 24 and the inner diameter of the cylindrical containing means 130, and the inner diameter of the window 143 of the fixed disc 142 is larger than the above-described diameters, the process agent 24 can be supplied smoothly.

The thickness of the rotatable shutter disc 144 is equal to or slightly thinner than that of the tablet type solid processing agent, and therefore, the processing agent can be surely supplied one by one.

The thickness of the fixed disc 142 is larger than that of the tablet type solid processing agent 24.

In the example, one processing agent is supplied at one rotation of the rotatable shutter disc 144. However, when a plurality of windows 145 are provided on the rotatable shutter disc 144 at regular intervals, the processing agent can be supplied 2 or 3 times as many as the foregoing at the same rotation speed.

As described above, the processing agent supply container (sub-tank) 20 in the present invention may be only a container having a space in which a predetermined number of the replenishing solid processing agents 24 are supplied, dissolved and filtered, and the replenisher for solution is circulated between the main processing tank 16 and the sub-tank 20 by a circulation pump (magnet pump) 18 for each processing container, and therefore, the space of the sub-tank 20 in the present invention can be greatly reduced as compared with that of a conventional replenisher tank.

According to the present invention, the size of the automatic processor can be greatly reduced as compared with a conventional automatic processor, and a low pollution system, in which a conventional plastic bottle is not necessary, can be realized. Further, even when concentration due to evaporation, oxidation of a processing solution, or reduction due to carry-out is caused, water or a replenishing solid processing agent is supplied automatically according to the above-described conditions in order to recover them. Therefore, a conventional manual operation can be eliminated, and manpower saving can be realized.

Further, while the replenishing solid processing agent is in the position ready to be supplied, the processing agent is prevented from being sprayed due to splattering from the liquid surface when the processing agent is dropped into a tank, and even when the replenishing solid processing agent is near each processing container while the processing agent is contained in a containing means, there is no possibility that the quality is reduced due to the moisture or spray of water, and thereby, a safe and compact developing system can be realized.

Next, in an automatic processor for photographing, a preferable example of a tablet supplying unit, by which tablets having the same diameter and different shapes can be supplied, and the performance of supplying function and moisture resistance function, and the performance of the entire supplying unit can be increased, will be described as follows.

The tablet supplying unit in the example comprises: a tablet containing means having a supply opening and containing tablets; a tablet conveying means holding and conveying tablets supplied one by one from the supply opening of the tablet containing means; and a tablet supplying means having a port and supplying one by one the tablet conveyed from the tablet conveying means.

In this example, a tablet is supplied from the supply opening of the tablet containing means, and the tablet is held and conveyed by the tablet conveying means. Tablets contained in the containing means are separated one by one and dropped from the port. The separation is conducted by a solid cam which will be described later. Therefore, even when the type of tablets is desired to be changed optionally and tablets having different thickness are dropped, the unit can be applied without being adjusted at the time, and further, dimensional adjustment is not necessary, and therefore, the unit is greatly advantageous in maintenance.

Figure 7:
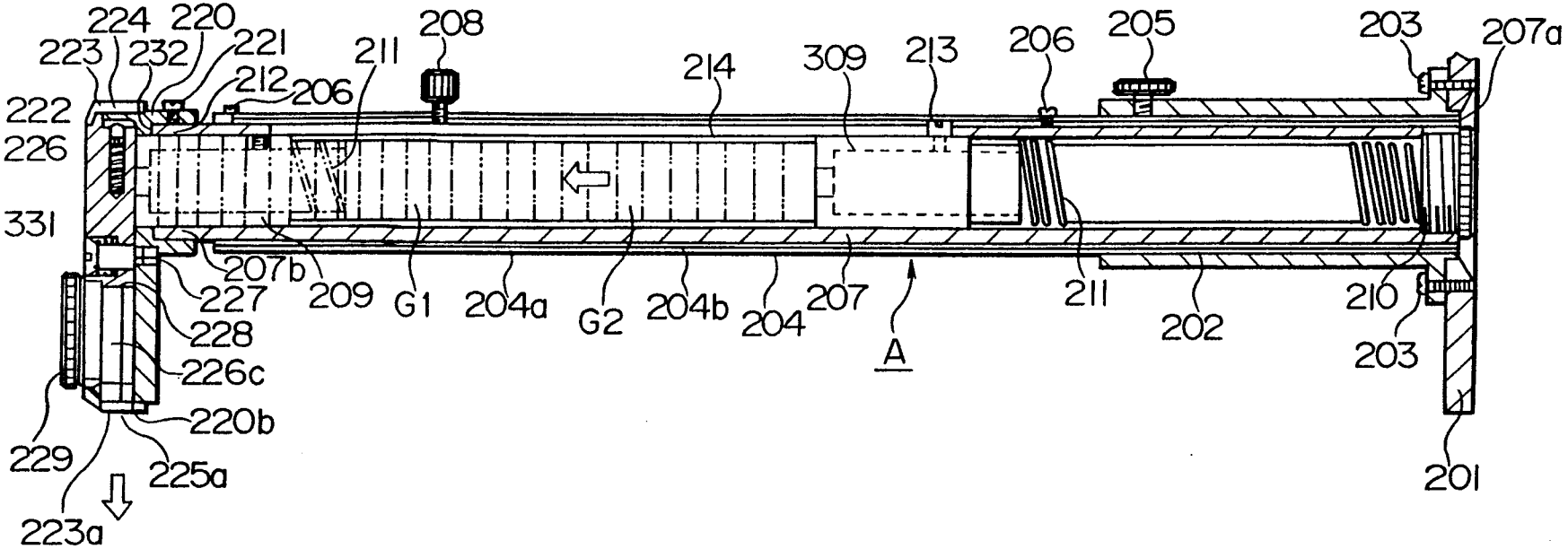
FIG. 7 is a sectional view showing a tablet dropping unit.
Figure 8:
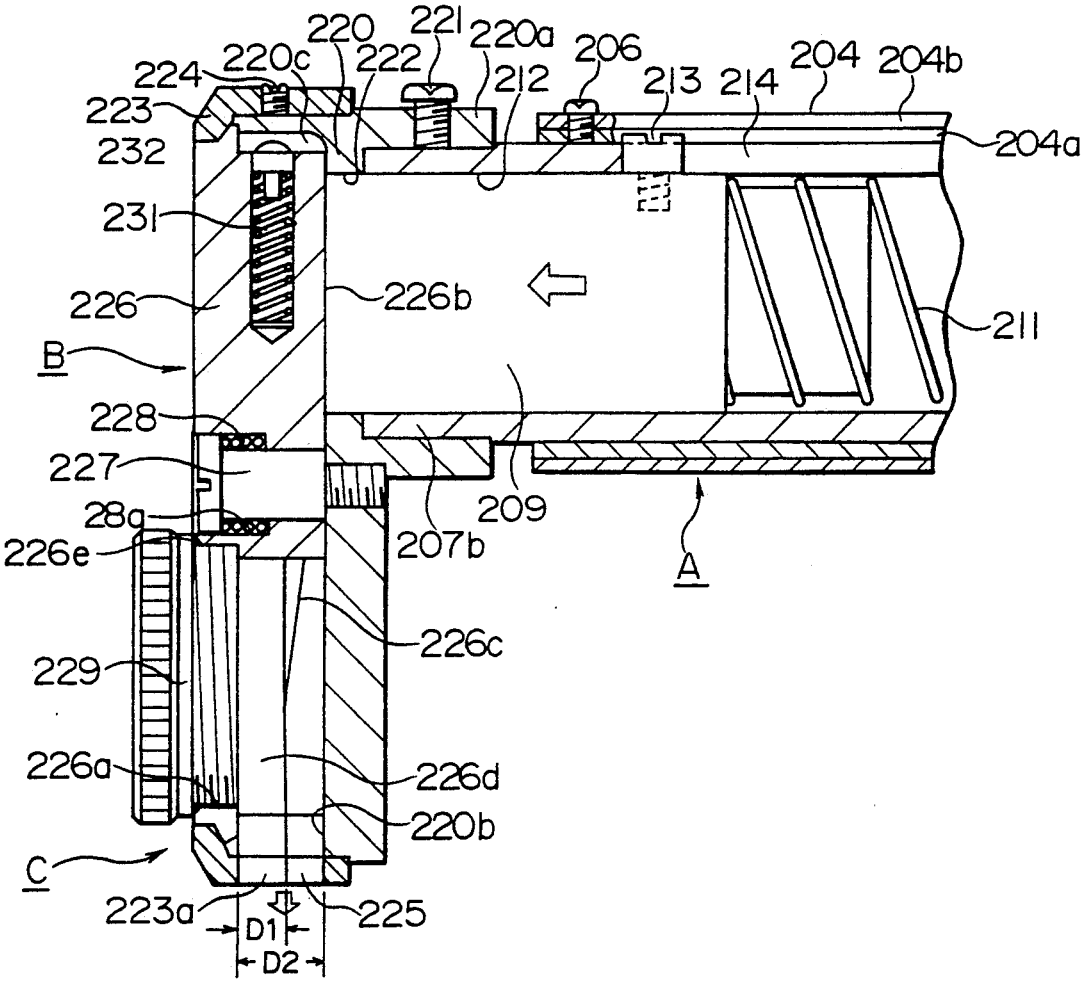
FIG. 8 is a sectional view showing a main portion of the tablet dropping unit.
Figure 9A:
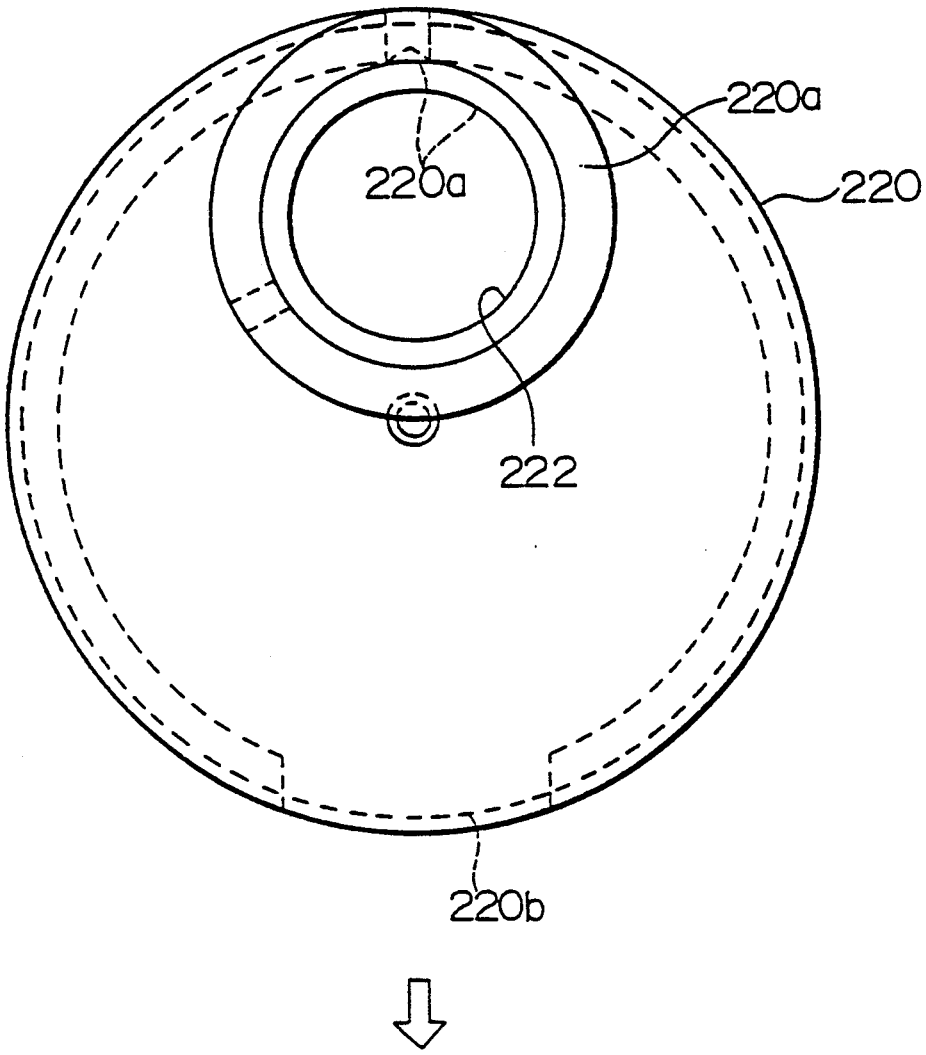
FIGS. 9A and 9B are side views, of a conveying holder.
Figure 9B:
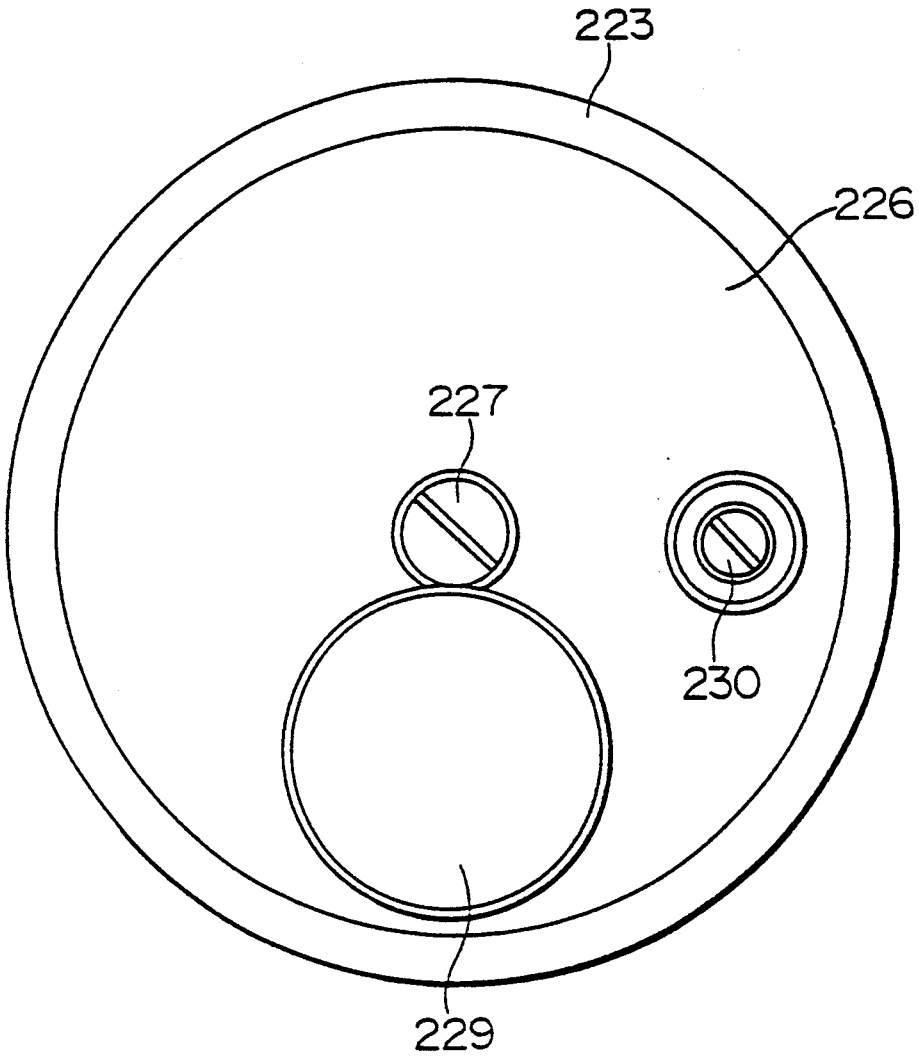
Figure 10:
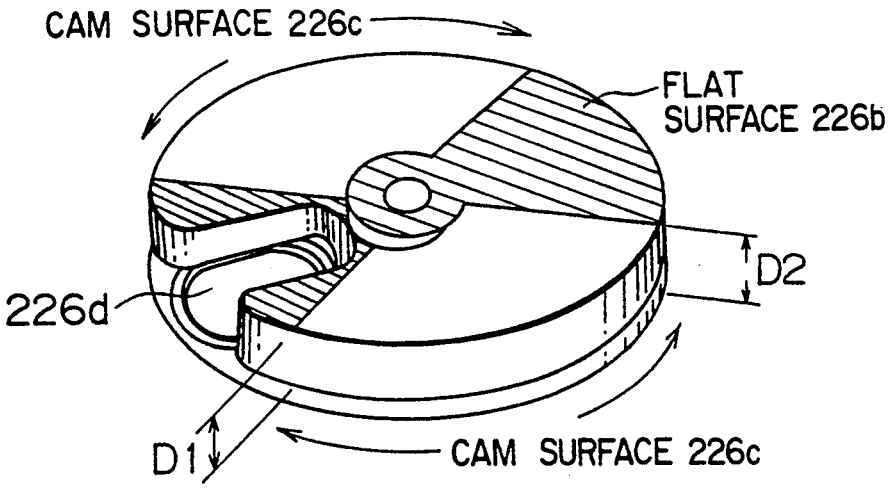
FIG. 10 is a perspective view of a conveying plate.
Figure 11A:
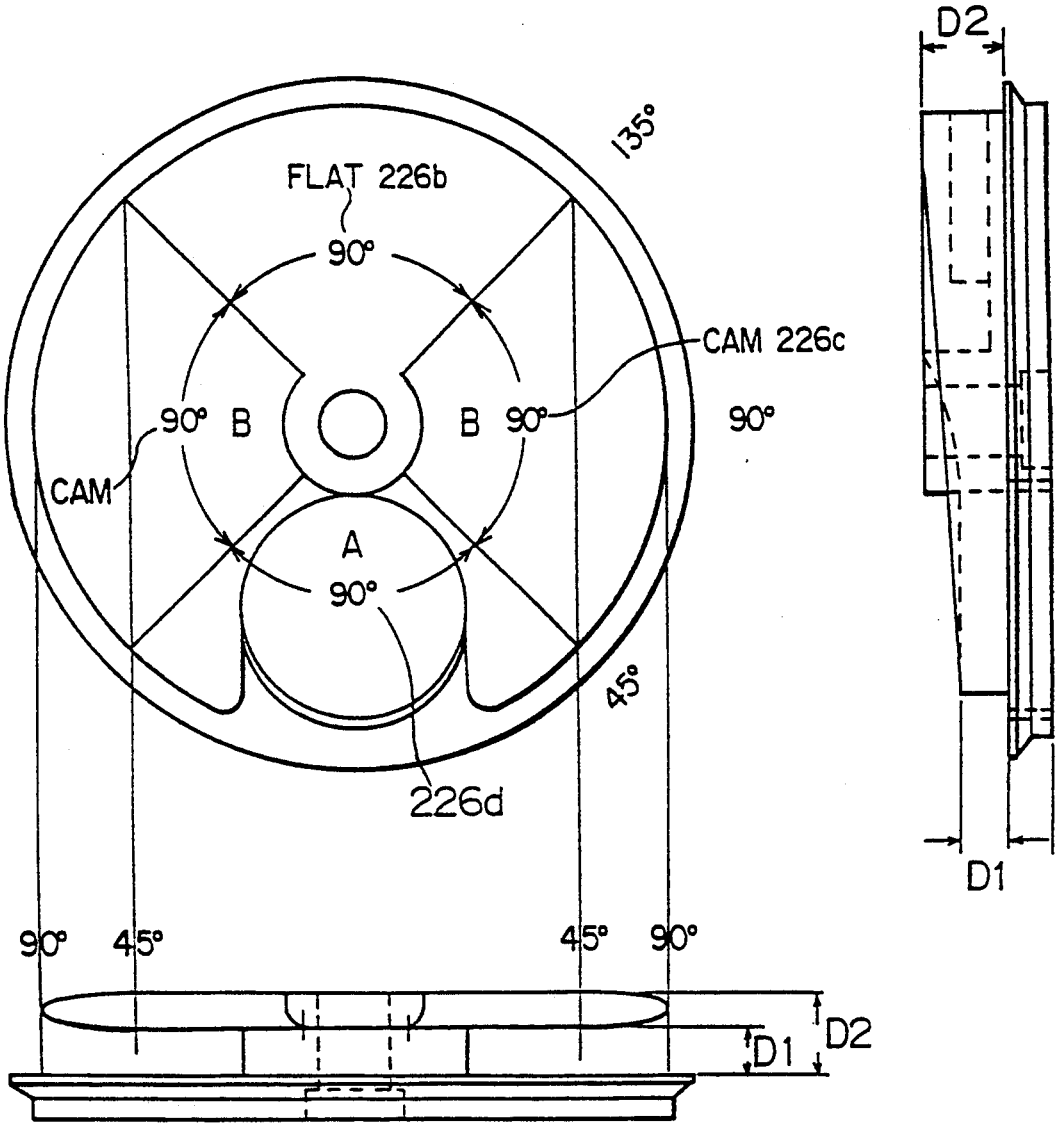
FIG. 11A and FIG. 11B are the developed views of the conveying plate shown in FIG. 10.
Figure 11B:
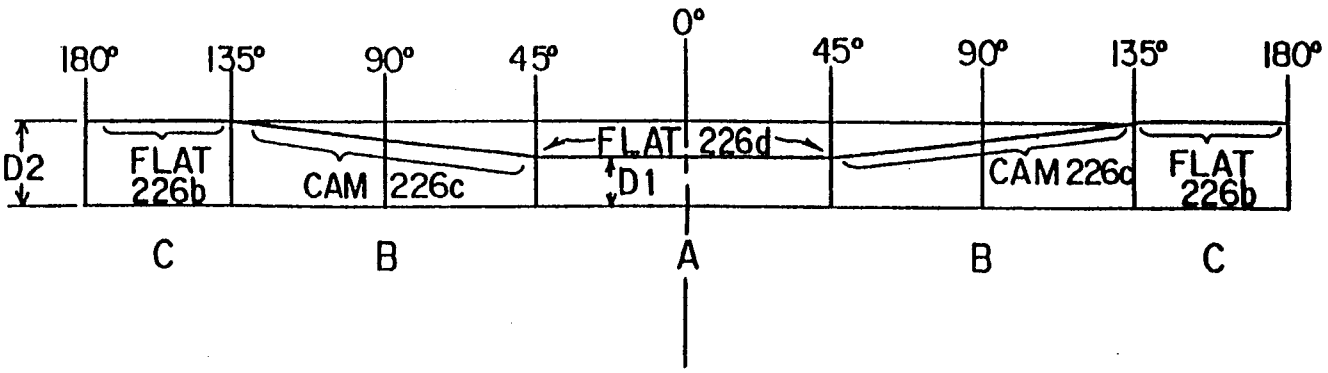

Referring to the attached drawings, an example of the tablet supplying unit of the present invention will be described in detail as follows. FIGS. 7 to 11 show an example of the tablet supplying means by which the tablet is fed in the lateral direction and dropped downward. FIG. 7 is a sectional view of the tablet supplying unit. FIG. 8 is a sectional, view of, a main portion of the tablet supplying unit. FIGS. 9A and 9B are side views of the conveying holder. FIG. 10 is a perspective view of the conveying plate. FIG. 11A and FIG. 11B are the developed views of the coveying plate shown in FIG. 10.

The tablet supplying unit is used for dropping the tablet into the tank successively at a scheduled time or periodically. The tablet supplying unit is structured as follows. A cylinder 202 is fixed to a supporting body 201 by machine screws 203, and one end of a supporting cylinder 204 is inserted into the cylinder 202 and fixed by a knob 205. The supporting cylinder 204 comprises an inner cylinder 204a and an outer cylinder 204b, and they are integrally formed into one body by fixing them by a knob 206. A containing cylinder 207 is inserted into the supporting cylinder 204 and fixed by a knob 208. A piston 209 is provided in the containing cylinder 207. A spring 211 is provided between the piston 209 and a cover 210 which is screwed in an end portion 207a of the containing cylinder 207, and the piston 209 is always pushed in the direction of a supply opening 212 of a leading edge portion 207b by the spring 211.

A guide pin 213 is provided to the piston 209, and is movably provided in the slot 214 which is formed in the direction of a shaft of the containing cylinder 207. A bending portion 214a is formed at the end portion of the slot 214, and the movement of the piston 209 is regulated when the guide pin 213 is positioned at the bending portion 214a. Under this condition, a plurality of tablets can be inserted from the supply opening 212. For example, tablets G1, G2 having different thickness are used as a plurality of tablets. Due to the foregoing, tablet containing means A having the supply opening 212 and containing a plurality of tablets with different thickness is structured by the containing cylinder 207, the piston 209, the spring 11 and the supply opening 212.

A mounting portion 220a of a conveying plate holder 220 is provided to the end portion 207b of the containing cylinder 207, and fixed by a machine screw 221. A carrying port 222 which is communicated with the supply opening 212 of the containing cylinder 207 is formed in the conveying plate holder 220. A slot 220b is formed in the conveying plate holder 220 in the position opposing to the carrying port 222.

A case 223 is provided to the conveying plate holder 220, and fixed to the conveying plate holder 220 by a machine screw 224. A window 223a is formed in the case 223 in the position opposing to the slot 220b of the conveying plate holder 220, and a port 225 is structured by the window 223a and the slot 220b. A tablet supplying means C is structured by the window 223a and the slot 220b, and tablets are conveyed from tablet conveying means B one by one.

A conveying plate 226 is rotatably held around a fixing screw 227 by the conveying plate holder 220 and the case 223 by which the tablet conveying means B is structured. The conveying plate 226 is fixed to the conveying plate holder 220 by the fixing screw 227 after a spring 228 is inserted into a fixing screw hole 226a of the shaft center. When the spring 228 is inserted into the hole 228a, the conveying plate 226 is pushed to the conveying plate holder 220, and is tightly contacted with the holder 220 so that moisture can be prevented. Further, in order to increase the degree of tight contact, soft material, for example,, synthetic rubber, may be pasted up on the conveying plate 226.

On the conveying plate 226, the following units are formed: a flat surface portion 226b by which the carrying port 222 of the conveying plate holder 220 is closed; an inclined cam surface 226c which is continuously connected with the flat surface portion 226b which receives a tablet and rotatably conveys the tablet; and a supplying slot 226d which is continuously connected with the cam surface 226c, and guides the tablet to the port 225. Further, a window 226e is formed at the position opposing to the supplying slot 226d on the conveying plate 226, and a cover 229 is screwed in the window 226. For example, when the tablet is stuffed in the supplying slot 226d, the tablet can be taken out by taking off the cover 229.

A rotary shaft 230 is provided to the conveying plate 226. When the conveying plate 226 is rotated by one rotation through the rotary shaft 230 by a motor which is stopped at each one rotation at the time of supplying one tablet, the flat surface portion 226b of the conveying plate 226 is separated from the carrying port 222, and the cam surface 226c which is continuously connected with the flat surface portion 226b receives the tablet and rotatably conveys it. When the conveying plate 226 is rotated further, the tablet enters into the supplying slot 226d which is continuously connected with the cam surface 226c, and is guided to the position opposite to the port 225. Then, a click 232, which is urged by the spring 231 provided to the conveying plate 226, enters into the slot 220c of the conveying plate holder 220, and the conveying plate 226 is positioned thereby, so that the tablet is dropped from the dropping port 225.

As is described in the foregoing, the tablet conveying means B comprises the conveying plate holder 220, the conveying plate 226 and the case 223, and the tablets, which are supplied one by one from the supply opening 212 of the containing cylinder 207 by which the tablet containing means A is composed, are held and conveyed by the tablet conveying means B. The minimum thickness of the tablet is limited by a width D1 of the supplying slot 226d of the conveying plate 226 and the maximum thickness of the tablet is limited by a width D2 measured from the bottom of the supplying slot 226d to the flat surface portion 226b. For example, when the thickness of tablet is $D1 < D2$, and the supplying slot 226d overlaps the carrying port 222, the second tablet is projected from the carrying port 222. However, when the conveying plate 226 is slidably moved, the second tablet is pushed by a solid cam 226c and returns into the containing cylinder 207. That is, when the thickness of the tablet is in the range from D1 to D2, the tablets can be freely supplied one by one.

Accordingly, even when the dimension of the tablet, especially the thickness, has some dispersion, the unit can be used without adjusting it at the time. Further, since the tablet's diameter is the same as that of others, although the thickness is different, many kinds of materials (such as chemicals) can be used. Further, when the content of the tablet is optionally changed, the thickness of the material can be changed correspondingly. Further, in this apparatus, when the tablet is inserted and dropped, it is not necessary to adjust the dimension of the unit, and therefore the apparatus is greatly advantageous in maintenance.

Figure 12:
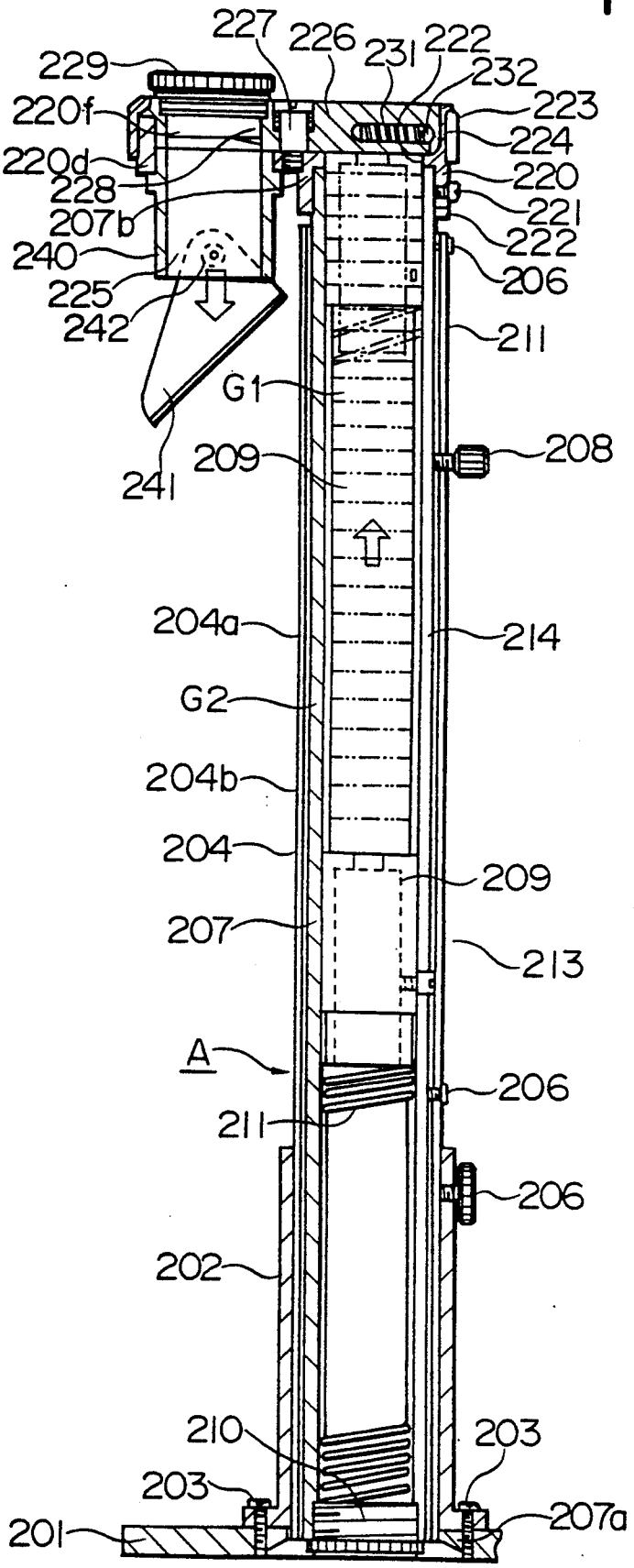
FIG. 12 is a sectional view of the tablet dropping unit.
Figure 13:
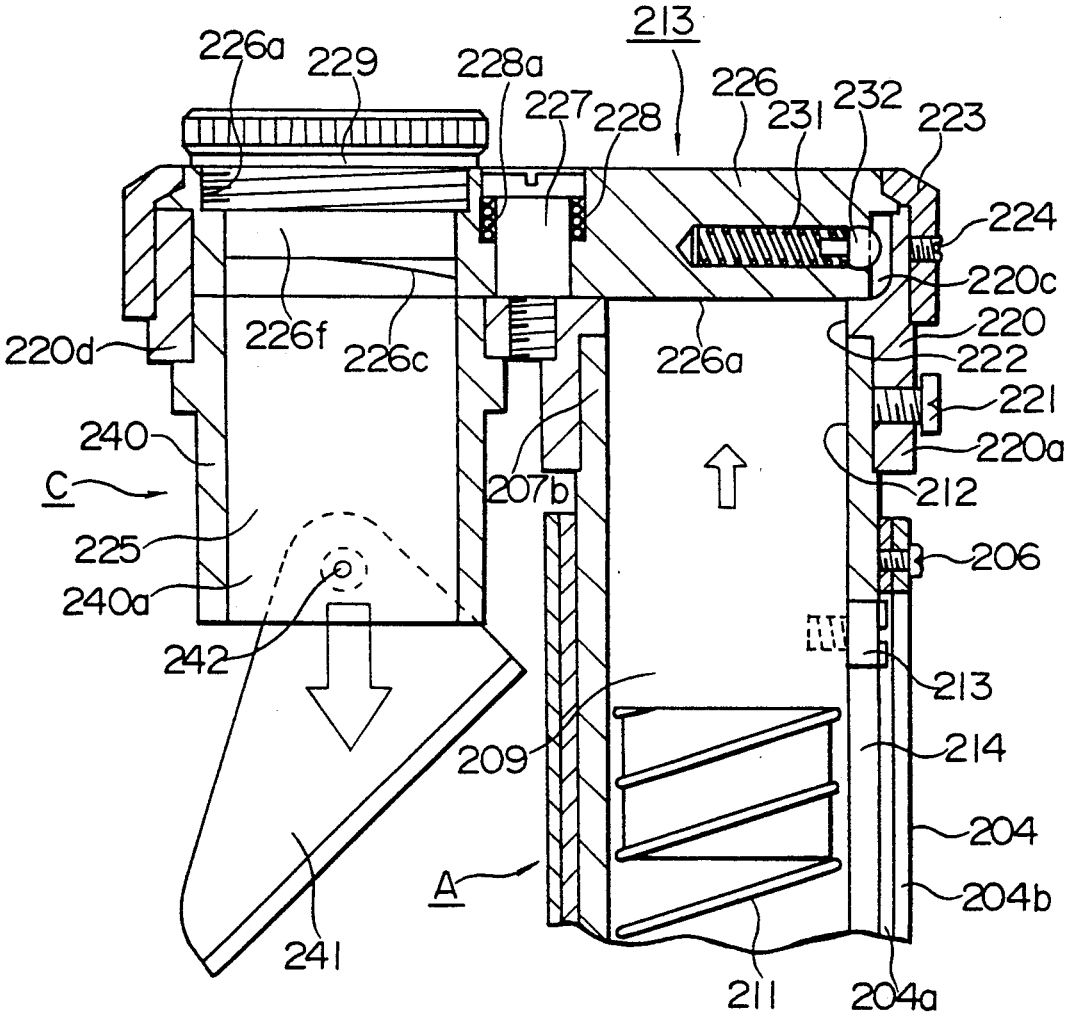
FIG. 13 is a sectional view of a main portion of the tablet dropping unit.
Figure 14:
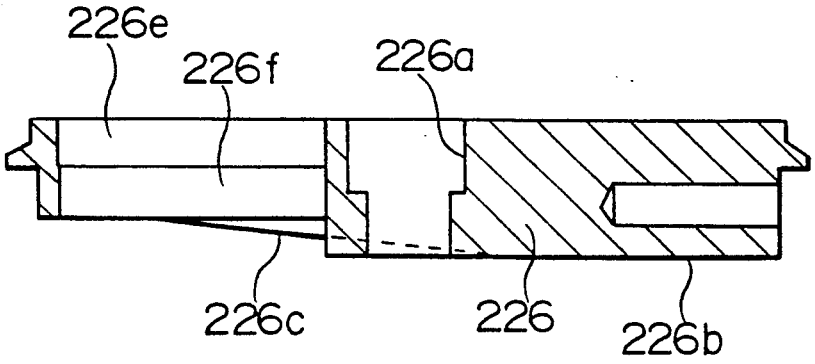
FIG. 14 is a sectional view of the conveying plate.

FIG. 12 to FIG. 14 show an example of the tablet dropping unit in which the tablet is pushed up from the lower portion, conveyed in the lateral direction and dropped downward. FIG. 12 is a sectional view of the tablet dropping unit. FIG. 13 is a sectional view of the main portion of the tablet dropping unit. FIG. 14 is a sectional view of the conveying plate.

The tablet dropping unit adopts the method in which the tablet is pushed up from the lower portion, conveyed in the lateral direction, and dropped downward. Since members having the same symbols as that of the example of the tablet dropping unit, in which the tablet is conveyed in the lateral direction and dropped downward, shown in FIGS. 7 to 11, are structured in the same way, the explanation is omitted.

In this example, the following units are provided on the conveying plate 226: a flat surface portion 226*b* which closes a carrying port 222 of a conveying plate holder 220; a cam surface 226*c* which is continuously connected with the flat surface portion 226*b*, receives the tablet, and rotatably conveys the tablet; a hole 226*f* which is continuously connected with the cam surface 226*c* and guides the tablet to a port 225. A cylinder 240 is press-fitted into a mounting portion 220*d* of the conveying plate holder 220. A path 240*a* of the cylinder 240 is communicated with the hole 226*f* of the conveying plate 226, and composes the port 225. A guide 241 is supported by a supporting pin 242 on the cylinder 240. Accordingly, at the time of dropping one tablet, when the conveying plate 226 is rotated by one rotation, the flat surface portion 226*b* of the conveying plate holder 220 is separated from the carrying port 222, and is continuously connected with the flat surface portion 226*b*, and the tablet is received and rotatably conveyed by the cam surface 226*c*. When the conveying plate 226 is rotated further, the tablet enters into the hole 226*f* which is communicated with the cam surface 226*c*. Then, the tablet is guided to the position opposite to the port 225 composed of the path 240*a* of the cylinder 240, is dropped from the port 225, and is guided by the guide 241 for supplying.

Figure 15:
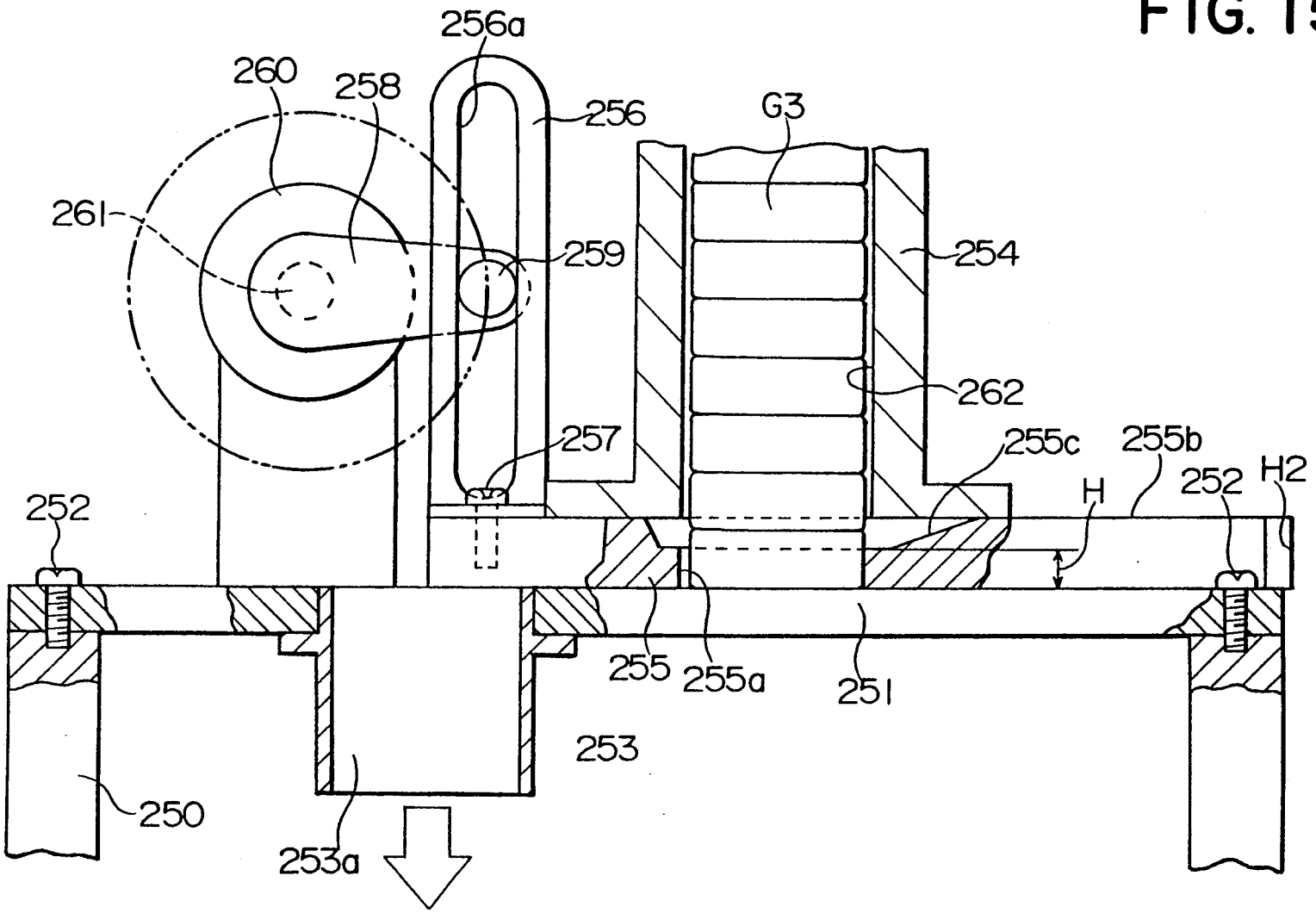
FIG. 15 is a sectional view of the tablet dropping unit before the tablet is dropped into the container.
Figure 16:
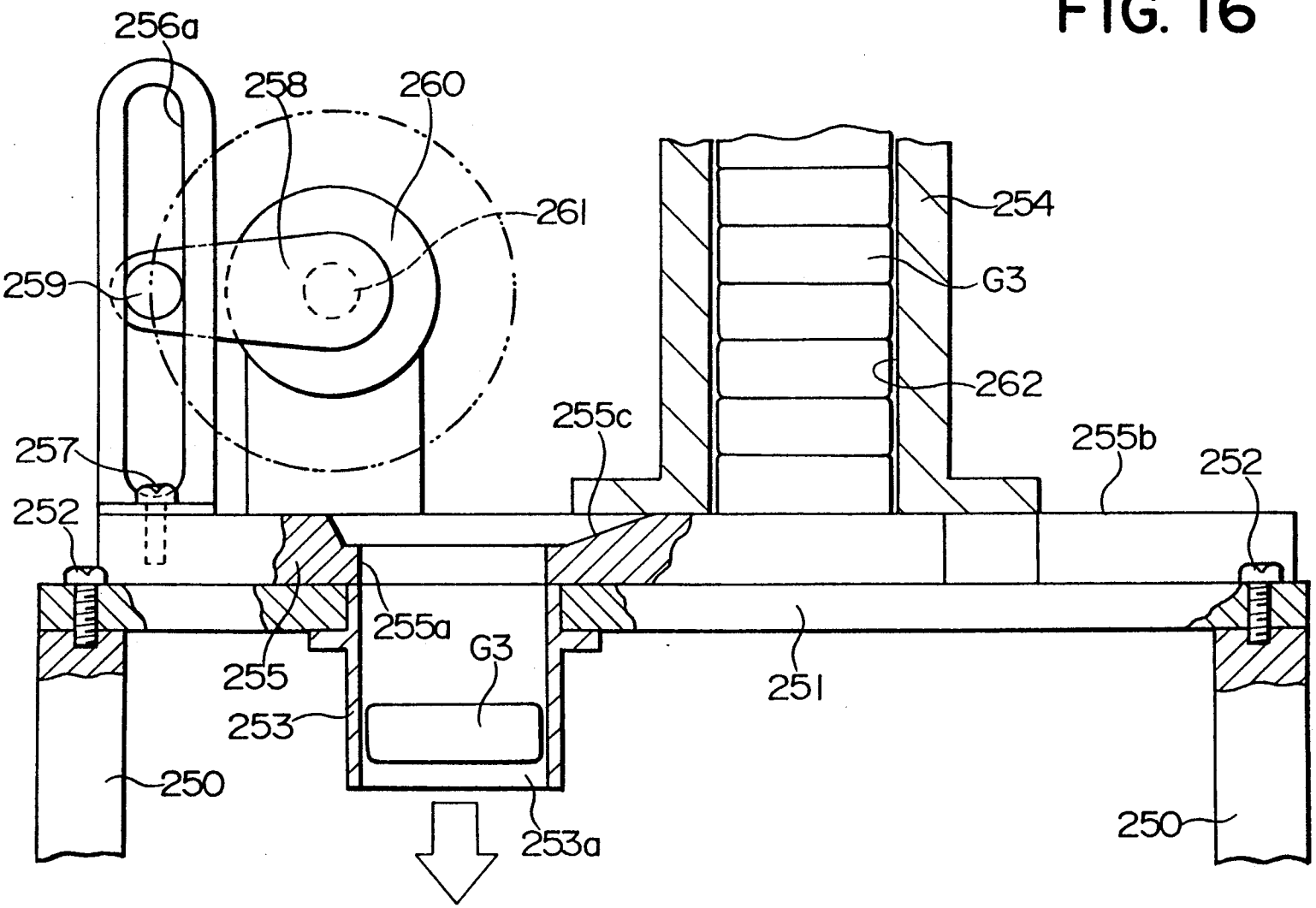
FIG. 16 is a sectional view of the tablet dropping unit after the tablet has been dropped into the container.

FIGS. 15 and 16 show the example of the tablet dropping unit using the method in which the tablets are piled on each other, conveyed in the lateral direction and dropped downward. FIG. 15 is a sectional view of the tablet dropping unit before the tablet is dropped. FIG. 16 is a sectional view of the tablet dropping unit after the tablet has been dropped.

In the tablet dropping unit, a supporting plate 251 is provided on a column 250 by a bolt 252, and a cylinder 253 is press-fitted into the lower side of the supporting plate 251. A cylinder 254 is provided on the upper side of the supporting plate 251, and tablets G3 are piled in the cylinder 254. A conveying plate 255 is provided in the movable relation on the supporting plate 251, and an arm 256 is fixed to the conveying plate 255 by a bolt 257. A pin 259 of a lever 258 is slidably provided in a slot 256*a* of the arm 256, and the lever 258 is fixed to an output shaft 261 of a motor 260. When the output shaft 261 of the motor 260 is rotated by 180°, it stops. Therefore, a hole 255*a* of the conveying plate 255 is provided in the manner that the hole 255*a* can move between the cylinder 254 and the cylinder 253.

A flat surface 255*b* which tightly closes a supply opening 262 of the cylinder 254 is provided on the conveying plate 255, and a cam surface 255*c* is provided around a dropping hole 255*a*. Before the tablet is dropped, the tablet G3 is inserted into the dropping hole 255*a* by its own weight. Under this condition, when the conveying plate 255 is moved to the cylinder 253, only the tablet G3, which is inserted into a dropping hole 255*a*, is conveyed by a cum surface 255*c* of the conveying plate 255, and the next tablet G3 is not supplied from the supply opening 262 of the cylinder 254.

The tablet G3 is conveyed to the position of the cylinder 53 by the conveying plate 255. In the condition shown in FIG. 16, the tablet G3 is naturally dropped from the port 253*a* of the cylinder 253 and supplied into the tank.

In the way described above, the tablet G3 is supplied into the tank. When the conveying plate 255 is moved to the position shown in FIG. 15 by 180° rotation of the motor, the lowest tablet G3 of the tablets piled in the cylinder 254 is inserted into the hole 255*a* by its own, weight by the cam surface 255*c*, and stands by for the next dropping. Height H1 of the hole 255*a* of the conveying plate 255 determines the minimum thickness of the tablet, height H2 of the conveying plate 255 determines the maximum thickness of the tablet, and the tablet whose thickness is between the above two thicknesses can be supplied freely.

Figure 17:
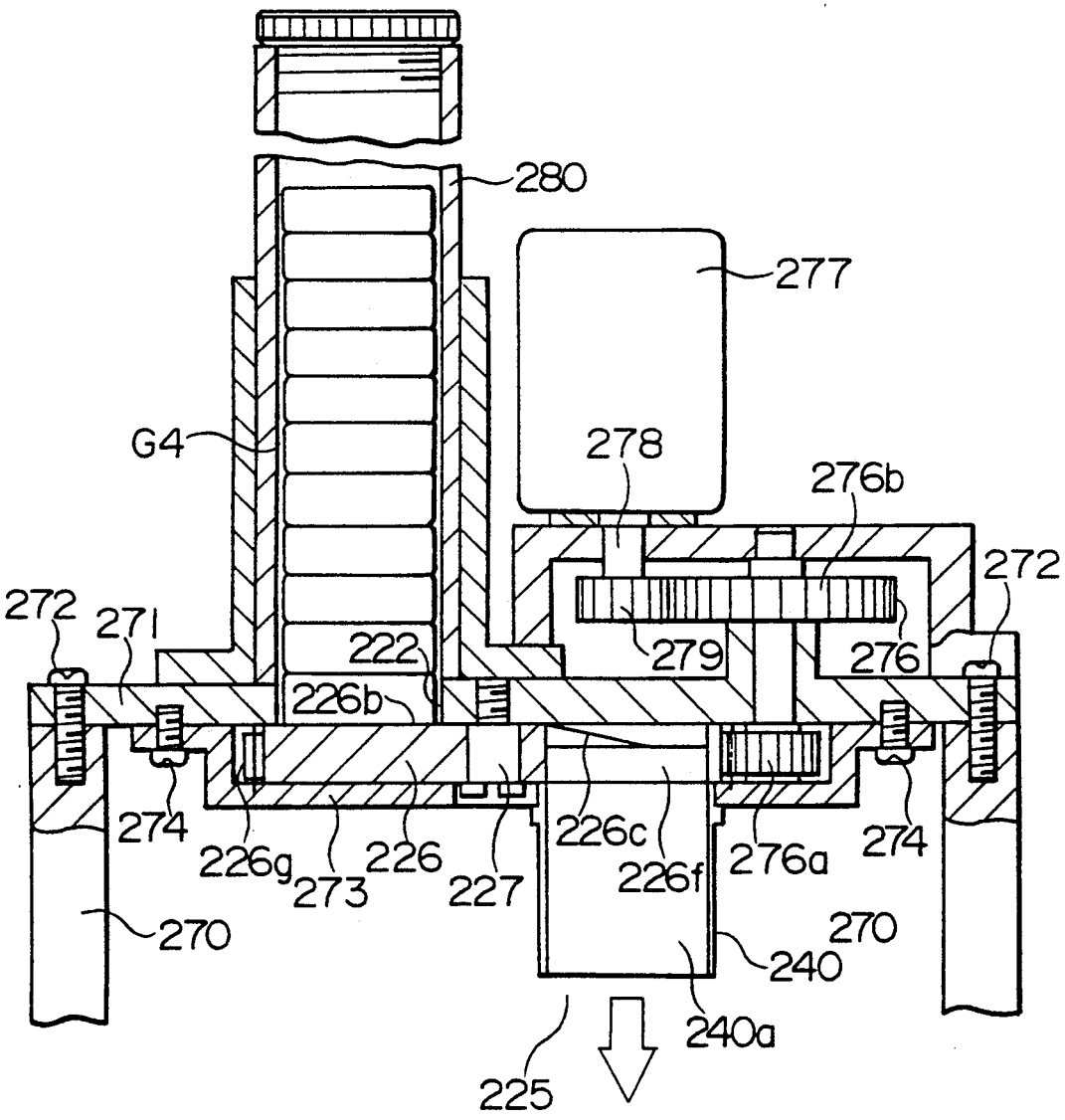
FIG. 17 is a sectional view of the tablet dropping unit.

FIG. 17 shows the example of the tablet dropping unit using the method in which tablets are piled on each other, and one tablet is conveyed in the lateral direction and dropped downward. FIG. 17 is a sectional view of the tablet dropping unit.

In the tablet dropping unit, a supporting plate 271 is provided to a column 270 by a bolt 272, and a cover 273 is provided to the lower side of the supporting plate 271 by a machine screw 274. A cylinder 240 is press-fitted into the cover 273 in which a conveying plate 226 is rotatably supported by a screw 227. The conveying plate 226 is structured in the same way as the example shown in FIGS. 12 to 14 A gear 226*g* is provided around the conveying plate 226, a gear 276*a* of a reduction gear mechanism 276 is engaged with the gear 226*g*, and a gear 276*b* is engaged with a gear 279 fixed to an output shaft 278 of a motor 277.

According, when the motor 277 is driven, the conveying plate 226 is rotated through the reduction gear mechanism, and one of tablets G4 is dropped from a cylinder 280 mounted on the upper side of the supporting plate 271, a flat surface portion 226*b* of a conveying plate holder 220 is separated from a carrying port 222 at the time of one rotation of the conveying plate 226, the tablet is received by a cam surface 226*c* which is continuously connected with the flat surface portion 226*b*, and is rotatably conveyed. When the conveying plate 226 is rotated further, the tablet enters into a hole 226*f* which is continuously connected with the cam surface 226*c*. The tablet is guided to the position opposite to a port 225 comprised of a path 240*a* of the cylinder 240, dropped from the port 225, guided by a guide 241, and supplied into the tank.

When a tablet receiving portion (a bottom portion) is provided to the conveying section, the tablet can be conveyed in the desired direction in the same way as the foregoing. In the drawing, a helical spring is used as a force to push the tablet. However, the present invention is not limited to the spring, but various publicly known structures such as a rack and pinion, or a feed screw may be used.

When a rack and pinion, or a feed screw is used as a force to push the tablet, it is preferable to use widely known sensors or a microswitch for detecting the position of the tablet and actuating the unit, although the sensor is not necessary in the case of a spring, see FIG. 8 members 227 and 228. It is also preferable to urge to the force to push the surface of the conveying section stronger than the force to push out the tablet so that moisture can be prevented.

As described above, in the present invention, the following operations are conducted: tablet are supplied from a supply opening of a tablet containing means one by one; the tablets are held and conveyed by a tablet conveying means; and the tablets conveyed are dropped one by one from a port of a tablet dropping means. Therefore, when the content of the tablet is optionally changed, the apparatus of the present invention can be used without any adjustment even when tablets with different thickness are supplied, and the apparatus is greatly advantageous in maintenance. Further, the tablet containing means is airtightly closed in which tablets are contained, moisture can be prevented thereby and therefore, tablets can be effectively preserved. Further, also in a automatic bait feeding machine for fishes, when a supply amount of a bait is changed, the tablet dropping unit can be effectively used when tablets having same diameter and different thickness are dropped.

What is claimed is:

1. An apparatus for processing a silver halide photographic material in a processing vessel containing a processing solution and an amount of moisture in the form of humidity therein, comprising:

storage means for storing a solid agent, which when added to said processing solution, maintains at least one characteristic of the processing solution within a predetermined range;

control means for monitoring a processing condition of the apparatus and for outputting a feeding signal in accordance with a monitoring result of the processing condition; and feed means for feeding the solid agent from the storage means to the processing vessel, the feed means including:

a feeding port through which the solid agent is fed into the processing vessel;

conveyance means for conveying the solid agent from the storage means to the feeding port so that the solid agent can pass through the feeding port; and open-close means for selectively opening and closing the feeding port such that when the open-close means closes the feeding port, the moisture in the form of humidity in the processing vessel is substantially prevented from entering into the storage means;

the open-close means being operated independently of the conveyance means in response to the feeding signal of the control means;

the control means controlling the open-close means to open the feeding port when the solid agent is to be fed into the processing vessel.

2. The apparatus of claim 1, wherein the control means includes:

detection means for detecting a processed area of the photographic material; and when the predetermined processed area is detected by the detection means to have a preselected characteristic, the control means outputs the feeding signal.

3. The apparatus of claim 1, wherein the conveyance means conveys at least one piece of solid agent to the feeding port in response to the feeding signal when the feeding port is opened by the open-close means.

4. The apparatus of claim 1, wherein:

the open-close means comprises a plate; and wherein:

when the plate is in a closed position, the solid agent conveyed by the conveyance mean is supported on the plate; and when the plate is in an open position, the solid agent drops by a force of gravity through the feeding port into the processing vessel.

5. The apparatus of claim 4, wherein:

the open-close means includes means for selectively opening and closing the open-close means so as to open the feeding port only when the solid agent is to be fed into the processing vessel;

the plate is a rotatable plate member for opening and closing the feeding port; and the rotatable plate member includes an aperture therein for receiving said solid agent such that the rotatable plate separates one piece of the solid agent from the storage means, and conveys the separated one piece of the solid agent to the processing vessel through the feeding port.

6. The apparatus of claim 1, wherein the solid agent comprises a tablet.

7. The apparatus of claim 6, wherein:

the storage means comprises means for holding a pile of a plurality of the tablets arranged in tandem in an axial direction of the tablets, said storage means having an aperture therein that is positioned coaxially with an axis of the tablets so as to pass the tablets therethrough;

the feed means comprises a movable plate member positioned to be opposite to the aperture of the storage means; and the storage means further comprises a bias member for urging the tablets toward the movable plate through the aperture of the storage means; and wherein the movable plate member comprises:

a flat portion arranged to block the aperture;

a concave portion to receive at least one of the tablets; and an inclined portion interconnecting the flat portion and the concave portion such that, as the movable plate moves along the aperture, at least one of the tablets is separated from the storage means and is moved into the concave portion of the plate member, and such that a next tablet that moves out of the storage means toward the separated tablet is moved back into the storage means by the inclined portion of the plate member.

8. The apparatus of claim 1, wherein the feed means is arranged relative to the processing vessel such that the feeding port faces a surface of the processing solution.

9. The apparatus of claim 1, wherein:

the storage means stores a plurality of pieces of the solid agent;

the feed means comprises separating means for separating one piece of the plurality of pieces of the solid agent stored in the storage means; and the open-close means opens the feeding port so as to allow only the separated one piece of the solid agent to pass through the feeding port.

10. The apparatus of claim 9, wherein the feed means includes the conveying means for conveying the separated one piece of the solid agent separated by the separating means to the feeding port.

11. The apparatus of claim 1, wherein the open-close means includes a rotatable plate member for selectively opening and closing the feeding port.

12. The apparatus of claim 11, wherein the rotatable plate member includes an aperture therein for receiving said solid agent such that the rotatable plate member separates one piece of the solid agent from the solid agent stored in the storage means, conveys the separated one piece of the solid agent and feeds the separated one piece of the solid agent to the processing vessel through the feeding port.

13. The apparatus of claim 12, wherein the aperture is tapered so as to receive various sizes of the solid agent.

14. The apparatus of claim 1, wherein the open-close means includes a shutter plate arranged to selectively open and close the feeding port.

15. The apparatus of claim 1, wherein the feed means includes a pair of shutter levers which are adapted to alternately move so that said solid agent is fed one piece at a time to the processing vessel.

16. The apparatus of claim 1, further comprising:

means for automatically adding additional liquid to the processing solution in the processing vessel to maintain, in combination with solid agent fed by the feeding means into the processing vessel, said at least one characteristic of said processing solution within said predetermined range.

17. The apparatus of claim 1, wherein said conveyance means is arranged so as to drop the solid agent through the feeding port in a substantially vertical direction.

18. An apparatus for processing a silver halide photographic material in a processing vessel containing a processing solution, comprising:

storage means for storing a solid agent, which when added to said processing solution, maintains at least one characteristic of the processing solution within a predetermined range;

feeding means, for feeding one piece of the solid agent from the storage means into the processing vessel, the feeding means including:

a feeding port for feeding the one piece of the solid agent into the processing vessel;

open-close means for opening and closing the feeding port, the open-close means including a rotatable plate member for opening and closing the feeding port;

the rotatable plate member including a hole therein for receiving the one piece of the solid agent such that the rotatable plate member separates the one piece of the solid agent from the solid agent stored in the storage means, conveys the separated one piece of the solid agent and feeds the separated one piece of the solid agent to the processing vessel through the feeding port; and the hole in the rotatable plate member being tapered so as to receive various sizes of the solid agent.

19. An apparatus for processing a silver halide photographic material in a processing vessel containing a processing solution, comprising:

storage means for storing a plurality of tablets therein, said plurality of tablets being used to keep at least one characteristic of the processing solution within a predetermined range;

means for feeding at least one of the plurality of tablets from the storage means into the processing vessel, the feeding means including:

a feeding port for feeding the at least one of the plurality of tablets into the processing vessel; and open-close means for opening and closing the feeding port;

the storage means including means for holding a pile of said plurality of tablets in tandem in an axial direction of the plurality of tablets, said storage means having a hole therein that is positioned coaxially with an axis of the plurality of tablets so as to pass the plurality of tablets therethrough;

the feeding means further comprising a movable plate member positioned to be opposite to the apertures of the storage means; and the storage means further having a bias member to urge the at least one of the plurality of tablets toward the movable plate through the aperture;

and wherein: the movable plate member comprises:

a flat portion to block the hole;

a concave portion to receive the at least one of the plurality of tablets therein; and an inclined portion interconnecting the flat portion and the concave portion such that, as the movable plate moves along the hole, the at least one of the plurality of tablets is separated from the storage means and is moved into the concave portion of the plate member, and such that, a next tablet, that moves out from the storage means toward the at least one separated tablet, is moved back into the storage means by the inclined portion of the plate member.

* * * * *